US008387791B2

(12) United States Patent
Huang

(10) Patent No.: US 8,387,791 B2
(45) Date of Patent: Mar. 5, 2013

(54) TOOLBOX

(76) Inventor: Jeng-Fung Huang, Taichung (TW)

( * ) Notice: Subject to any disclaimer, the term of this patent is extended or adjusted under 35 U.S.C. 154(b) by 60 days.

(21) Appl. No.: 13/092,405

(22) Filed: Apr. 22, 2011

(65) Prior Publication Data

US 2012/0267271 A1 Oct. 25, 2012

(51) Int. Cl.
*B65D 85/00* (2006.01)

(52) U.S. Cl. ..... 206/378; 206/373; 206/493

(58) Field of Classification Search ..... 206/372, 206/373, 378, 493, 377, 349, 376, 379, 762, 206/759; 211/70.6
See application file for complete search history.

(56) References Cited

U.S. PATENT DOCUMENTS 5,570,784 A * 11/1996 Sidabras et al. ..... 206/378
6,070,745 A * 6/2000 Dembicks ..... 211/70.6
6,105,770 A * 8/2000 Vasudeva ..... 206/378
6,386,363 B1 * 5/2002 Huang ..... 206/378
7,270,235 B2 * 9/2007 Chen ..... 206/379
7,658,284 B2 * 2/2010 Lin ..... 206/378
2003/0141211 A1 * 7/2003 Tsai ..... 206/378
2003/0205493 A1 * 11/2003 Chen et al. ..... 206/378
2004/0084342 A1 * 5/2004 Chang ..... 206/378
2004/0188366 A1 * 9/2004 Tong ..... 211/70.6
2005/0121344 A1 * 6/2005 Chang ..... 206/378
2005/0230587 A1 * 10/2005 Yang ..... 248/314
2006/0254940 A1 * 11/2006 Mu et al. ..... 206/378
2011/0048989 A1 * 3/2011 Winnard ..... 206/378

* cited by examiner

*Primary Examiner* — David Fidei
(74) *Attorney, Agent, or Firm* — Ming Chow; Sinoricia, LLC

(57) ABSTRACT

A toolbox has a box body and a clamping device. The box body has a casing and a cover. The casing has two opposite sidewalls and a chamber. The cover is attached to the casing. The clamping device is mounted in the casing and has at least one holding shaft and multiple clamping mounts. The at least one holding shaft is mounted securely in the casing and each has two ends connected to the opposite sidewalls of the casing. The clamping mounts are rotatably mounted on the at least one holding shaft in the casing and each has a clamping frame and two clamping arms. The clamping frame is rotatably mounted on the at least one holding shaft. The clamping arms are formed on and protrude upwardly from the clamping frame at an interval to form an inserting recess between the clamping arms and each has an engaging protrusion.

5 Claims, 6 Drawing Sheets

TOOLBOX

BACKGROUND OF THE INVENTION

1. Field of the Invention

The present invention relates to a toolbox, and more particularly to a toolbox that can be adjusted to move or rotate the tools inside the toolbox to improve the practicability of the toolbox.

2. Description of Related Art

Conventional toolboxes are used to store hand tools, sockets, socket wrenches or instruments. A conventional toolbox has a casing and a cover. The casing has a chamber and a pad. The pad is mounted in the chamber of the casing and has multiple recesses. The recesses are formed through the pad and each recess has a specific and fixed shape corresponding to a tool, a socket, a socket wrench or an instrument. The cover is pivotally attached to the casing.

Although the recesses of the pad of the conventional toolbox can hold hand tools, sockets, socket wrenches or instruments, the sizes and shapes of the recesses are fixed and cannot change or adjust to store hand tools, sockets, socket wrenches or instruments of different shapes and this will limit the practicability of the conventional toolbox.

To overcome the shortcomings, the present invention provides a toolbox to mitigate or obviate the aforementioned problems.

SUMMARY OF THE INVENTION

The main objective of the present invention is to provide a toolbox that can be adjusted to move or rotate the tools inside the toolbox to improve the practicability of the toolbox.

The toolbox in accordance with the present invention has a box body and a clamping device. The box body has a casing and a cover. The casing has two opposite sidewalls and a chamber. The cover is attached pivotally to the casing. The clamping device is detachably mounted in the chamber of the casing and has at least one holding shaft and multiple clamping mounts. The at least one holding shaft is mounted securely in the chamber of the casing and each has an external surface and two ends connected to the opposite sidewalls of the casing. The clamping mounts are rotatably mounted on the at least one holding shaft in the chamber of the casing and each clamping mount has a clamping frame and two clamping arms. The clamping frame is rotatably mounted on the external surface of the at least one holding shaft. The clamping arms are formed on and protrude upwardly from the clamping frame at an interval to form an inserting recess between the clamping arms and each clamping arm has an engaging protrusion.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
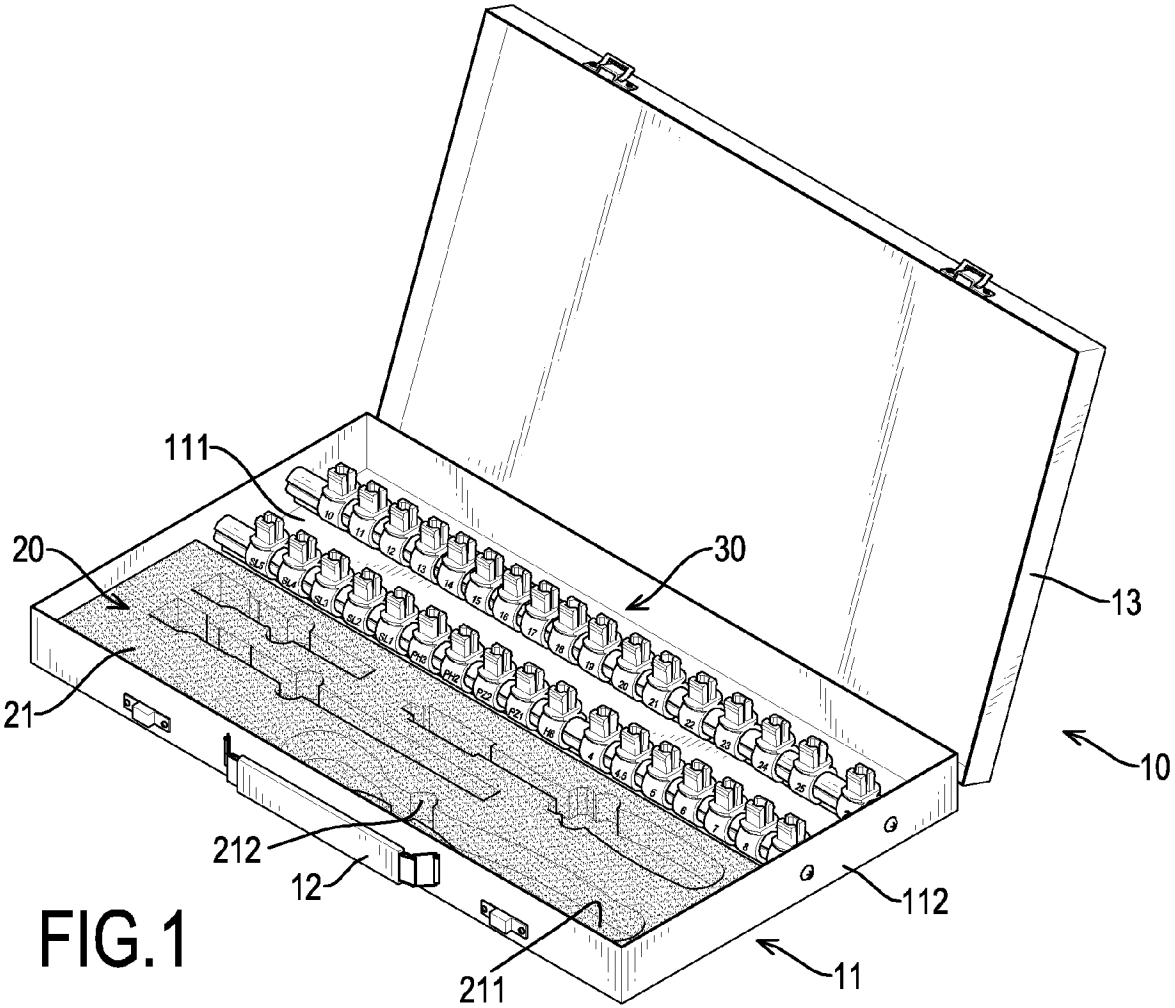
FIG. 1 is a perspective view of a toolbox in accordance with the present invention with a cover of the toolbox being opened.
Figure 2:
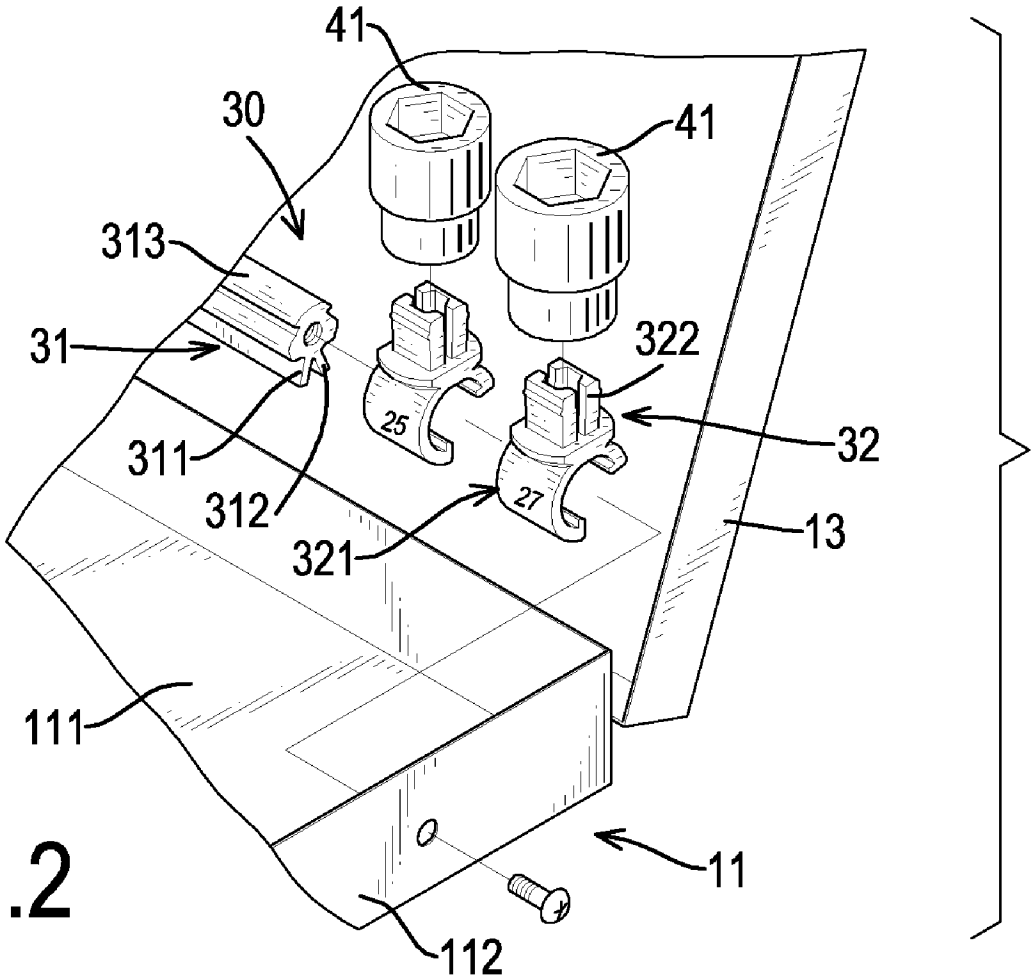
FIG. 2 is a partially enlarged and exploded view of a clamping device of the toolbox in FIG. 1.
Figure 3:
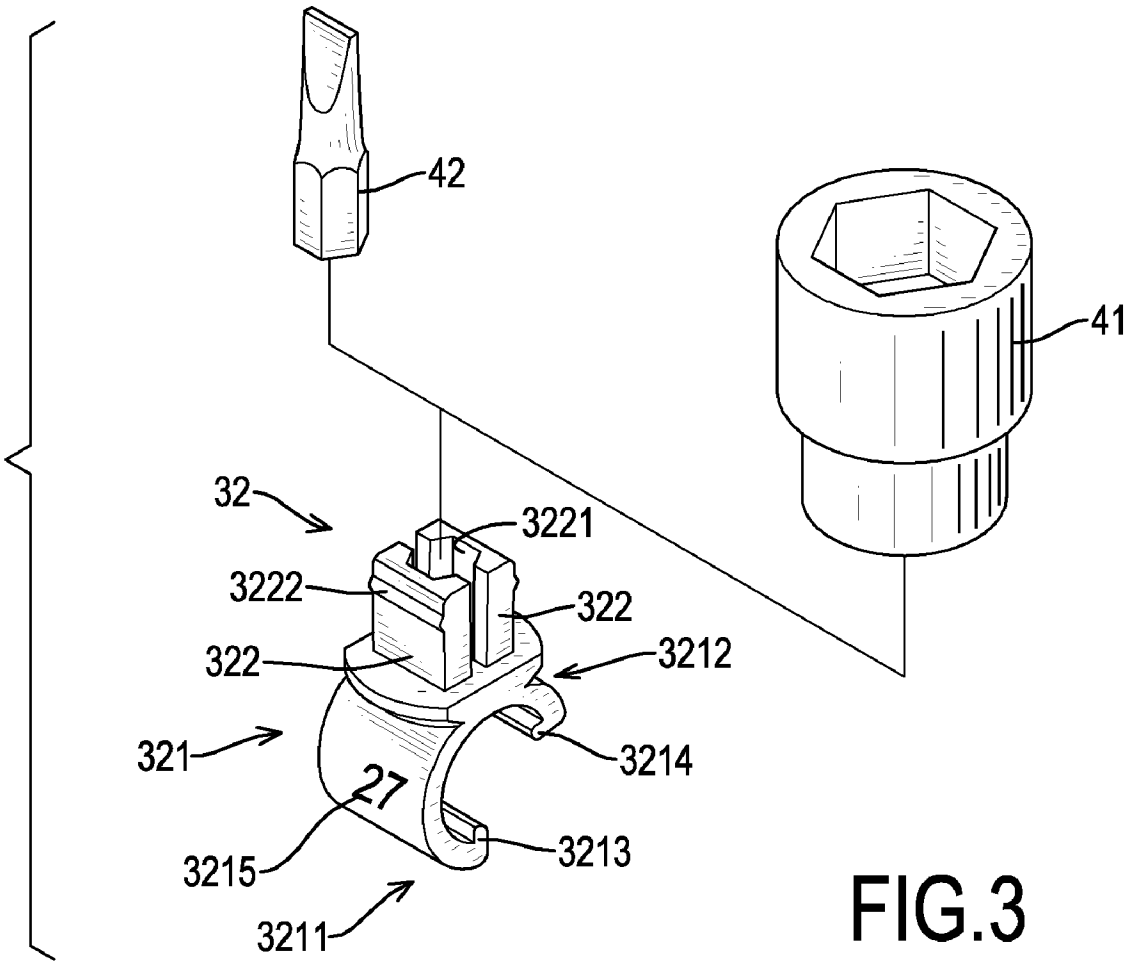
FIG. 3 is an enlarged perspective view of a clamping mount of the clamping device of the toolbox in FIG. 2 mounted with a bit head or a socket.
Figure 4:
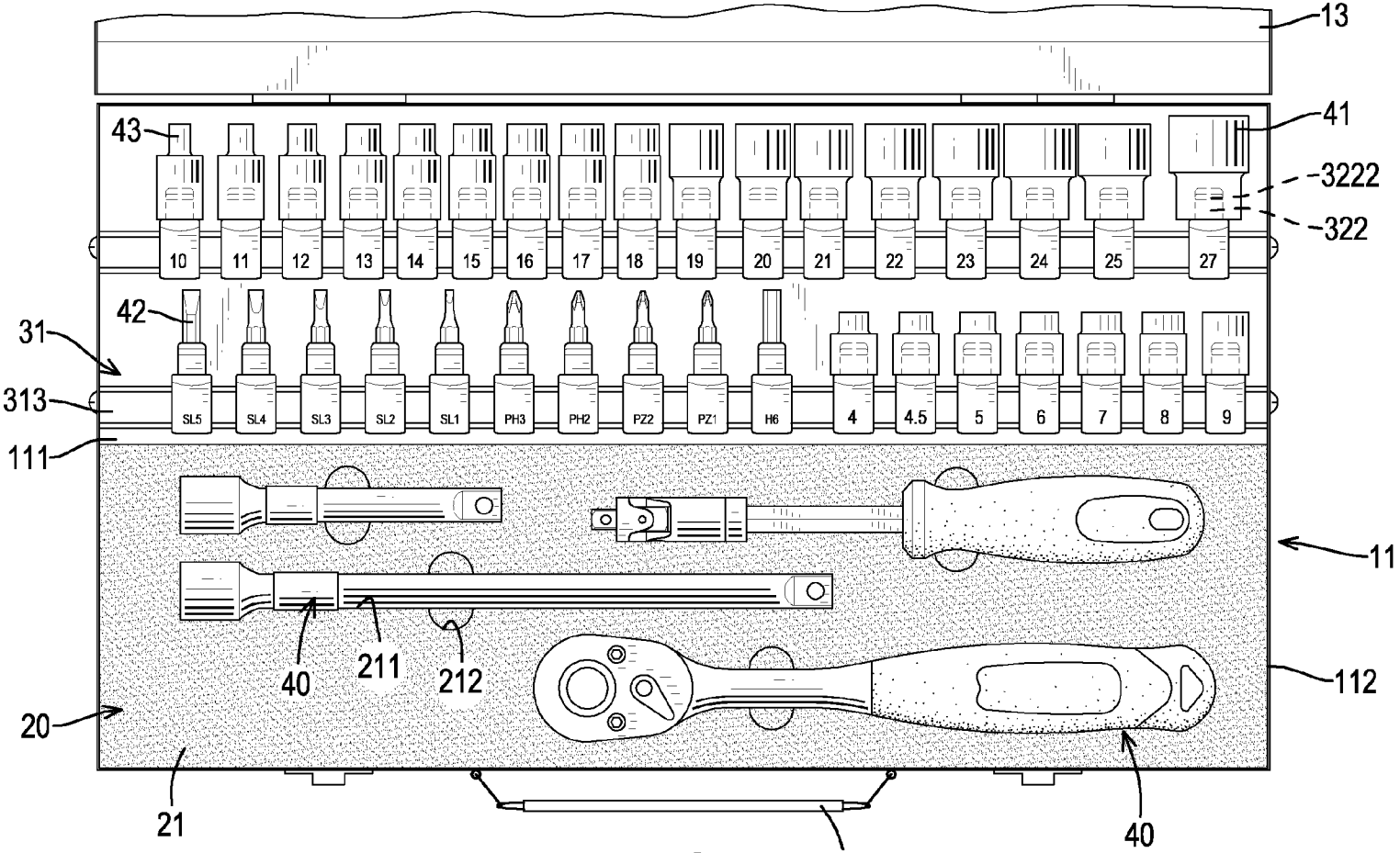
FIG. 4 is a top view of a casing of the toolbox in FIG. 1 mounted with multiple hand tools, sockets and bit heads.

With reference to FIGS. 1 to 5B, a toolbox in accordance with the present invention comprises a box body 10, a positioning device 20 and a clamping device 30.

The box body 10 has a casing 11, a handle 12 and a cover 13. The casing 11 may be rectangular and has a closed bottom, an open top, a front side, a rear side, two opposite sidewalls 112 and a chamber 111. The sides of the casing 11 are formed on and protrude from the closed bottom of the casing 11 and are parallel to each other. The opposite sidewalls 112 of the casing 11 are formed on and protrude from the closed bottom of the casing 11, are respectively connected to the sides of the casing 11 and are parallel to each other. The chamber 111 is formed in the casing 11 between the sides and the opposite sidewalls 112 of the casing 11. The handle 12 is attached on the front side of the casing 11 for raising and carrying the toolbox. The cover 13 is attached pivotally to the rear side of the casing 11.

The positioning device 20 is mounted in the chamber 111 of the casing 11 of the box body 10 and has a pad 21. The pad 21 is mounted securely in the chamber 111 of the casing 11 between the opposite sidewalls 112 and adjacent to the front side of the casing 11 and has a top surface, multiple recesses 211 and multiple pairs of taking cavities 212. The recesses 211 are formed in the top surface of the pad 21, each recess 211 is an elongated shaped to hold a hand tool and has two sidewalls. Each pair of the taking cavities 212 are respectively formed in the sidewalls of the recess 211 and communicate with the corresponding recess 211 to enable s user to get the hand tool out of the recess 211 easily.

The clamping device 30 is detachably mounted in the chamber 111 of the casing 11 of the box body 10 between the rear side and the opposite sidewalls 112 of the casing 11 and the positioning device 20 and has two holding shafts 31 and multiple clamping mounts 32. The holding shafts 31 are mounted securely in the chamber 111 of the casing 11 at an interval, and each holding shaft 31 has two ends, a top side, a bottom side, an external surface, a first limiting bar 311, a second limiting bar 312 and a retaining protrusion 313. The ends of each holding shaft 31 are respectively connected securely to the opposite sidewalls 112 of the casing 11 by screws. The first limiting bar 311 is elongated, is formed on and protrudes downwardly from the external surface of the holding shaft 31 at the bottom side of the holding shaft 31 and has a free end faced to the closed bottom of the casing 11. The second limiting bar 312 is formed on and protrudes obliquely from the external surface of the holding shaft 31 and has an included angle relative to the first limiting bar 311. The retaining protrusion 313 is formed on and protrudes from the external surface of the holding shaft 30 at the top side of the holding shaft 30 and has a first retaining face 314 and a second retaining face 315.

The clamping mounts 32 are rotatably mounted on the holding shafts 31 in the chamber 111 of the casing 11, and each clamping mount 32 has a clamping frame 321 and two clamping arms 322. The clamping frame 321 may be C-shaped in cross section, is rotatably mounted on the external surface of the holding shaft 31 between the limiting bars 311, 312, is mounted slidably on the retaining protrusion 313 of the holding shaft 31 and selectively abuts one of the retaining faces 314, 315 of the retaining protrusion 313 and one of the limiting bars 311, 312. Each clamping frame 321 has a first hooking segment 3211 and a second hooking segment 3212.

The first hooking segment 3211 of the clamping frame 321 is mounted between the external surface and the retaining protrusion 313 of the holding shaft 30, selectively abuts the first limiting bar 311 and the first retaining face 314 of the retaining protrusion 313 and has a free end, an external surface, a first hook 3213 and a mark 3215. The first hook 3213 is formed on protrudes from the free end of the first hooking segment 3211, selectively abuts the first limiting bar 311 and selectively engages the first retaining face 314 of the retaining protrusion 313. The mark 3215 may be a numeral or a symbol and is formed on the external surface of the first hooking segment 3211 of the clamping frame 321.

The second hooking segment 3212 is mounted between the external surface and the retaining protrusion 313 of the holding shaft 31, is formed with the first hooking segment 3211, selectively abuts the second retaining face 315 of the retaining protrusion 313 and the second limiting bar 312 and has a free end and a second hook 3214. The second hook 3214 is formed on protrudes from the free end of the second hooking segment 3212, selectively engages the second retaining face 315 of the retaining protrusion 313 and selectively abuts the second limiting bar 312.

The clamping arms 322 are formed on and protrude upwardly from the second hooking segment 3212 of the clamping frame 321 at an interval to form an inserting recess 3221 between the clamping arms 322, and each clamping arm 322 has an inner surface, an outer surface and an engaging protrusion 3222. The inner surfaces of the clamping arms 322 face to each other. The engaging protrusion 3222 is formed on and protrudes from the outer surface of the clamping arm 322.

In use, with reference to FIGS. 2, 3, 4 and 6, the inserting recess 3221 between the pair of clamping arms 322 of each clamping mount 32 can be used to hold a bit head 42 and the engaging protrusions 3222 of the pair of clamping arms 322 can be used to engage a socket 41 or a socket bit 43, 44, 45. In addition, the mark 3215 formed on the clamping frame 321 of each clamping mount 32 can provide a distinguishing effect to the user. Therefore, the sockets 41, the bit heads 42 and the socket bits 43, 44, 45 can be mounted and positioned in the casing 11 of the box body 10 by the clamping device 30 of the toolbox. Furthermore, the sockets 41, bit heads 42 and socket bits 43, 44, 45 of different kinds and sizes can be to mounted and positioned in the chamber 111 of the casing 11 by moving the clamping mounts 32 relative to the corresponding holding shaft 31 to adjust the intervals between the clamping mounts 32. In addition, multiple hand tools 40 can be mounted and positioned in the recesses 211 of the pad 21 and can be taken out of the pad 21 easily due to the arrangement of the pair of taking cavities 212.

Figure 5B:
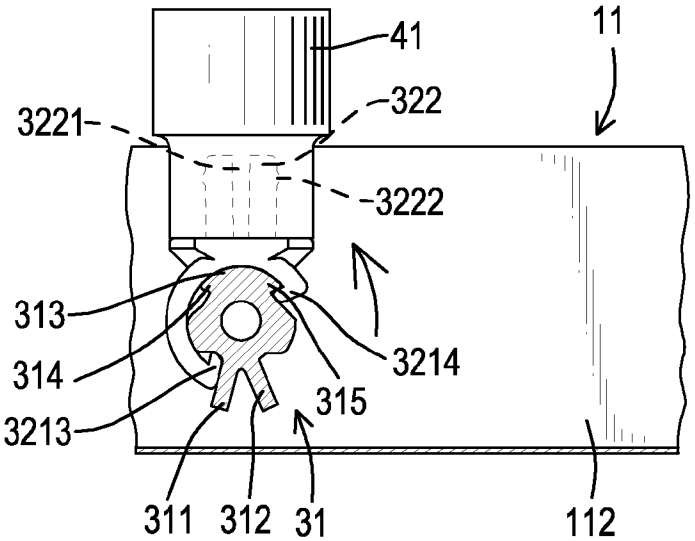
FIG. 5B is an operational side view in partial section of the clamping device of the toolbox in FIG. 5A.
Figure 5A:
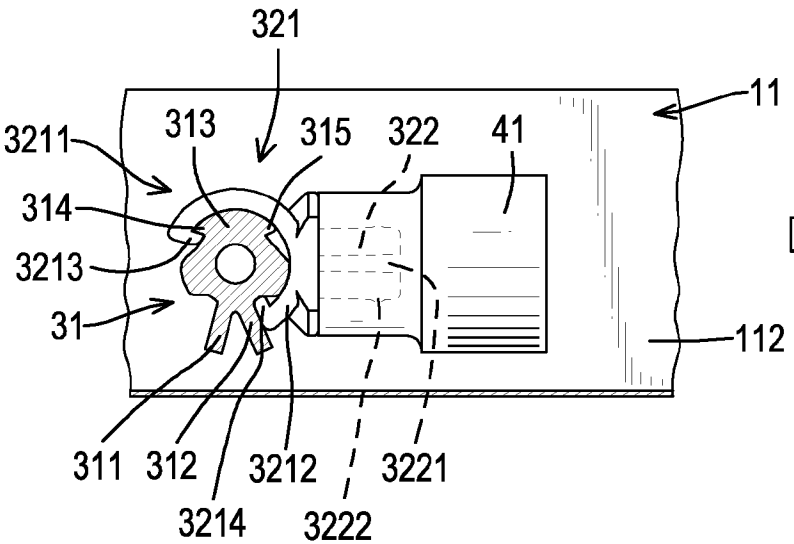
FIG. 5A is a side view in partial section of the clamping device of the toolbox in FIG. 3 mounted with a socket.
Figure 6:
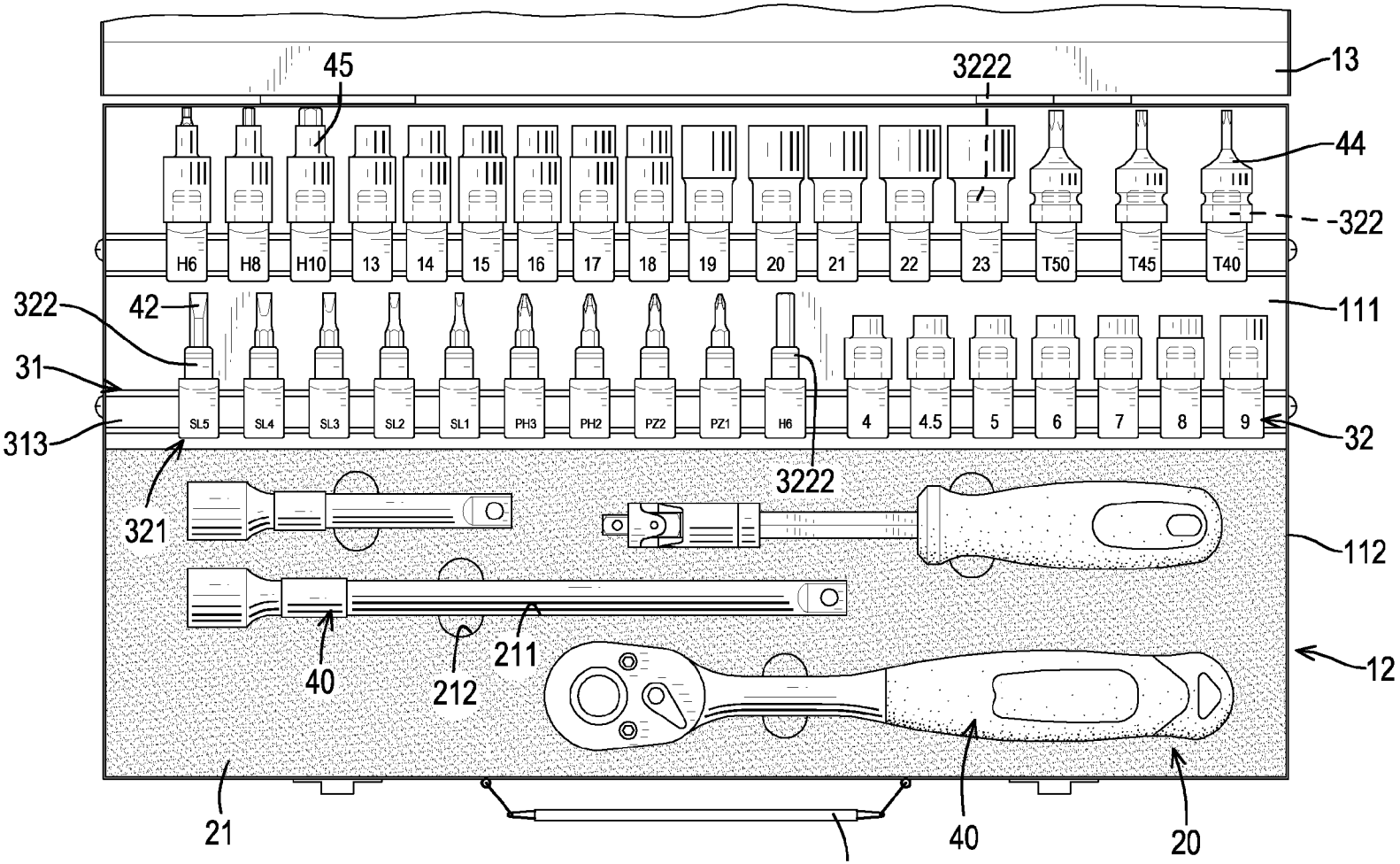
FIG. 6 is an operational top view of the toolbox in FIG. 1 mounted with multiple hand tools, sockets, socket bits and bit heads.

With reference to FIG. 5A, when a socket 41 is mounted and positioned in the chamber 111 of the casing 11 by a corresponding clamping mount 32, the first hook 3213 of the first hooking segment 3211 of the clamping frame 321 engages the first retaining face 314 of the retaining protrusion 313 and the second hook 3214 of the second hooking segment 3212 of the clamping frame 321 abuts the second limiting bar 312 of the corresponding holding shaft 31 to enable the socket 41 to be mounted and positioned horizontally inside the chamber 111 of the casing 11.

In addition, with reference to FIG. 5B, when a user wants to take the socket 41 out of the casing 11, the clamping mount 32 can be rotated relative to the corresponding holding shaft 31 to enable the clamping arms 322 of the clamping arm 32 to rotate relative to the corresponding holding shaft 31 and to extend out of the opening top of the casing 11 where the first hook 3213 of the first hooking segment 3211 of the clamping frame 321 abuts the first limiting bar 311 of the corresponding holding shaft 31 and the second hook 3214 of the second hooking segment 3212 of the clamping frame 321 engages the second retaining face 315 of the retaining protrusion 313. Then, the socket 41 mounted around the clamping arms 322 can extend out of the opening top of the casing 11 and the user can take the socket 41 out of the casing 11 easily and conveniently.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A toolbox having
a box body having
a casing having
a closed bottom;
an opening top;
a front side formed on and protruding from the closed bottom of the casing;
a rear side formed on and protruding from the closed bottom of the casing and being parallel to the front side;
two opposite sidewalls formed on and protruding from the closed bottom of the casing, respectively connected to the sides of the casing and being parallel to each other; and
a chamber formed in the casing between the front and rear sides and the opposite sidewalls of the casing; and
a cover attached pivotally to the rear side of the casing; and
a clamping device detachably mounted in the chamber of the casing of the box body adjacent to the rear side of the casing and having
at least one holding shaft mounted securely in the chamber of the casing and each one of the at least one holding shaft having
an external surface;
two ends respectively connected securely to the opposite sidewalls of the casing;
a top side;
a bottom side;
a first limiting bar being elongated, formed on and protruding downwardly from the external surface of the holding shaft at the bottom side of the holding shaft and having a free end facing to the closed bottom of the casing;
a second limiting bar formed on and protruding obliquely from the external surface of the holding shaft and having an included angle relative to the first limiting bar; and
a retaining protrusion formed on and protruding from the external surface of the holding shaft at the top side of the holding shaft and having a first retaining face and a second retaining face;

multiple clamping mounts rotatably mounted on the at least one holding shaft in the chamber of the casing, and each clamping mount having a clamping frame rotatably mounted on the external surface of a corresponding one of the at least one holding shaft between the limiting bars of the corresponding holding shaft, mounted slidably on the retaining protrusion of the corresponding holding shaft to selectively abut one of the retaining faces of the retaining protrusion and one of the limiting bars of the corresponding holding shaft and having;

a first hooking segment mounted between the external surface and the retaining protrusion of the corresponding holding shaft, selectively abutting the first limiting bar and the first retaining face of the retaining protrusion of the corresponding holding shaft and having a free end;

an external surface; and a first hook formed on and protruding from the free end of the first hooking segment and selectively abutting the first limiting bar of the corresponding holding shaft and engaging the first retaining face of the retaining protrusion of the corresponding holding shaft; and a second hooking segment mounted between the external surface and the retaining protrusion of the corresponding holding shaft, formed with the first hooking segment, selectively abutting the second retaining face of the retaining protrusion of the corresponding holding shaft and the second limiting bar of the corresponding holding shaft and having a free end; and a second hook formed on and protruding from the free end of the second hooking segment and selectively engaging the second retaining face of the retaining protrusion of the corresponding holding shaft and abutting the second limiting bar of the corresponding holding shaft; and two clamping arms formed on and protruding upwardly from the clamping frame at an interval to form an inserting recess between the clamping arms, and each clamping arm having an inner surface facing to the inner surface of the other clamping arm;

an outer surface; and an engaging protrusion formed on and protruding from the outer surface of the clamping arm.

2. The toolbox as claimed in claim 1, wherein the first hooking segment of the clamping frame of each clamping frame has a mark formed on the external surface of the first hooking segment of the clamping frame.

3. The toolbox as claimed in claim 2, wherein the toolbox has a positioning device mounted in the chamber of the casing of the box body between the clamping device and the front side of the casing and having a pad mounted securely in the chamber of the casing between the opposite sidewalls of the casing adjacent to the front side of the casing and having a top surface;

multiple recesses formed in the top surface of the pad and having two sidewalls; and multiple pairs of taking cavities respectively formed on the sidewalls of the recesses, and each pair of taking cavities communicating with a corresponding recess; and the clamping device is detachably mounted in the chamber of the casing of the box body between the rear side and the opposite sidewalls of the casing and the positioning device and has two holding shafts mounted securely in the chamber of the casing at an interval.

4. The toolbox as claimed in claim 3, wherein the box body has a handle attached on the front side of the casing.

5. The toolbox as claimed in claim 1, wherein the toolbox has a positioning device mounted in the chamber of the casing of the box body between the clamping device and the front side of the casing and having a pad mounted securely in the chamber of the casing between the opposite sidewalls of the casing adjacent to the front side of the casing and having a top surface;

multiple recesses formed in the top surface of the pad and having two sidewalls; and multiple pairs of taking cavities respectively formed on the sidewalls of the recesses and each pair of taking cavities communicate with a corresponding recess; and the clamping device is detachably mounted in the chamber of the casing of the box body between the rear side and the opposite sidewalls of the casing and the positioning device and has two holding shafts mounted securely in the chamber of the casing at an interval.

* * * * *